US007276017B2

(12) United States Patent
Chen

(10) Patent No.: US 7,276,017 B2
(45) Date of Patent: Oct. 2, 2007

(54) PEDAL ANGLE ADJUSTABLE DEVICE FOR EXERCISERS

(75) Inventor: Ming Nan Chen, Taichung (TW)

(73) Assignee: Michael Lin, Taipei (TW)

( * ) Notice: Subject to any disclaimer, the term of this patent is extended or adjusted under 35 U.S.C. 154(b) by 218 days.

(21) Appl. No.: 11/235,006

(22) Filed: Sep. 26, 2005

(65) Prior Publication Data

US 2007/0072742 A1 Mar. 29, 2007

(51) Int. Cl.
*A63B 22/04* (2006.01)

(52) U.S. Cl. ..... 482/52; 482/62

(58) Field of Classification Search ..... 482/51, 482/52, 57, 62; 74/512
See application file for complete search history.

(56) References Cited

U.S. PATENT DOCUMENTS 5,683,331 A * 11/1997 Dalebout ..... 482/52
5,690,589 A * 11/1997 Rodgers, Jr. ..... 482/57
6,500,096 B1 * 12/2002 Farney ..... 482/52
7,037,242 B2 * 5/2006 Lo et al. ..... 482/52

* cited by examiner

*Primary Examiner*—Stephen R. Crow
(74) *Attorney, Agent, or Firm*—Charles E. Baxley

(57) ABSTRACT

A pedal angle adjustable device for an elliptical trainer includes two adjustable plates pivotably connected between the pedal and two connection plates which are pivotably connected to an end of the pedal. The two adjustable plates each have a positioning hole composed of a plurality of positioning notches and a positioning rod extends through the two connection plates and the positioning holes in the two positioning plates. A push block connected to a handle is located in front of the positioning rod such that when operating the handle, the push block may push the positioning rod from one positioning notch to another and the pedal can be pivoted about the pivotal point on the end of the pedal.

8 Claims, 8 Drawing Sheets

PEDAL ANGLE ADJUSTABLE DEVICE FOR EXERCISERS

FIELD OF THE INVENTION

The present invention relates to a pedal angle adjustable device for exercisers and the device is operated by a handle.

BACKGROUND OF THE INVENTION

A conventional pedal 6 for an exerciser such as an elliptical trainer is shown in FIGS. 10 and 11 and generally includes a connection member 61 which is connected to an underside of the pedal 6. The connection member 61 has three holes 611 defined therethrough. Two plates 7 are respectively and pivotably connected to a link connected to the magnetic wheel which is not shown. Each plate 7 has a slot 71 so that an adjustable pin 8 extends through the aligned slots 71 and one of the three holes 611 to position the angle of the peal 6 relative to the floor. However, when adjusting the pedal 6, the user has to pull the adjustable pin 8 out and hold the pedal 6 and move the pedal 6 till the desired hole 611 is in alignment with the two slots 71 of the plate 7, and the pin 8 is inserted into the alignment hole 611 and the slots 71. This is obviously a difficult task for most of the uses.

The present invention intends to provide a pedal angle adjustable device and includes a handle which is directly connected to the underside of the pedal so that the user may operate the handle to adjust the pedal more easily and conveniently.

SUMMARY OF THE INVENTION

The present invention relates to an elliptical trainer which comprises a base with a magnet wheel connected thereto and two swing bars are pivotably connected to the base and two pedal rods are pivotably connected to the two swing bars. Two connection plates are pivotably connected to each of the pedal rods and a pedal is connected to the two connection plates. Two links each have an end pivotably connected to the magnetic wheel and the other end of each link has a roller which is movably engaged with rails of the base. The two connection plates are respectively pivotably connected to the two links. A pivotable portion is fixed to an underside of the pedal and an adjustable portion including two adjustable plates is pivotably connected to the two connection plates. A pin extends through the pivotable portion and the adjustable plates. Each adjustable plate further includes a positioning hole which is composed of a plurality of positioning notches so that a positioning rod extends through the positioning holes of the two adjustable plates and is pivotably connected between the two connection plates. A push block is located between the two adjustable plates of each pedal and a handle is connected to the push block such that when operating the handle, the push block moves the positioning rod from one positioning notch to another, and the pedal is then pivoted an angle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
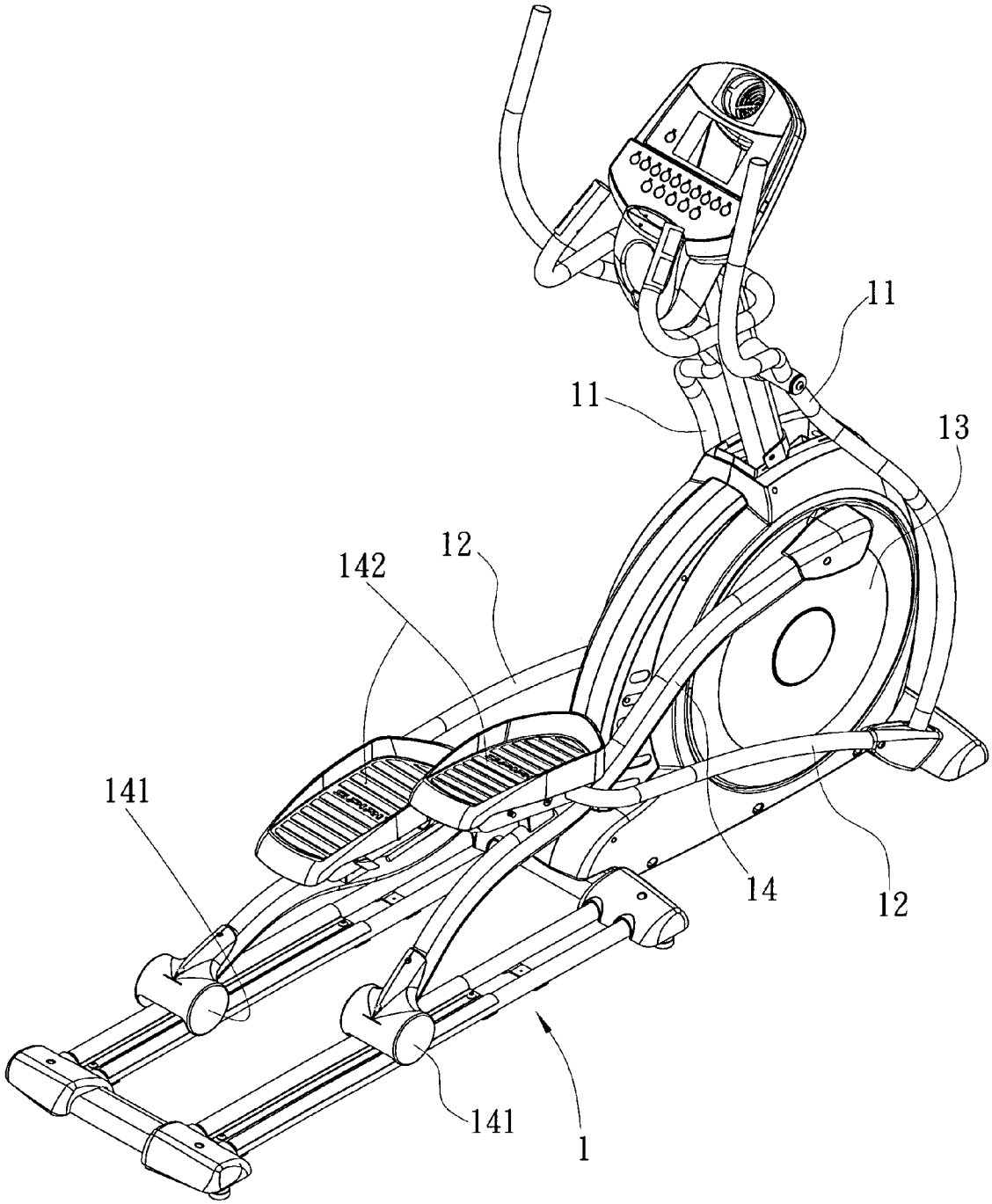
FIG. 1 is a perspective view to show the elliptical trainer with the pedal angle adjustable device of the present invention.
Figure 2:
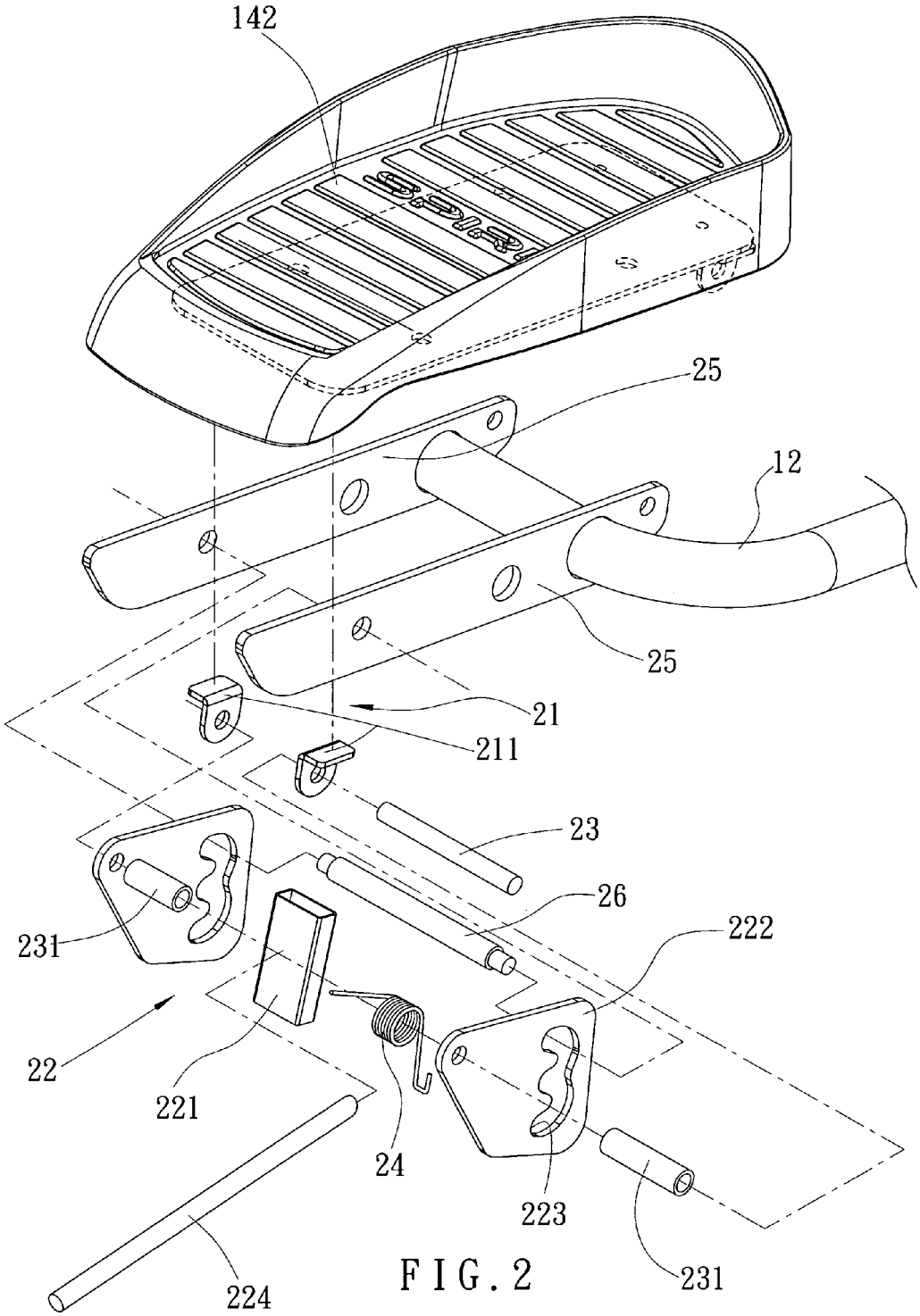
FIG. 2 is an exploded view to show the pedal angle adjustable device of the present invention.
Figure 3:
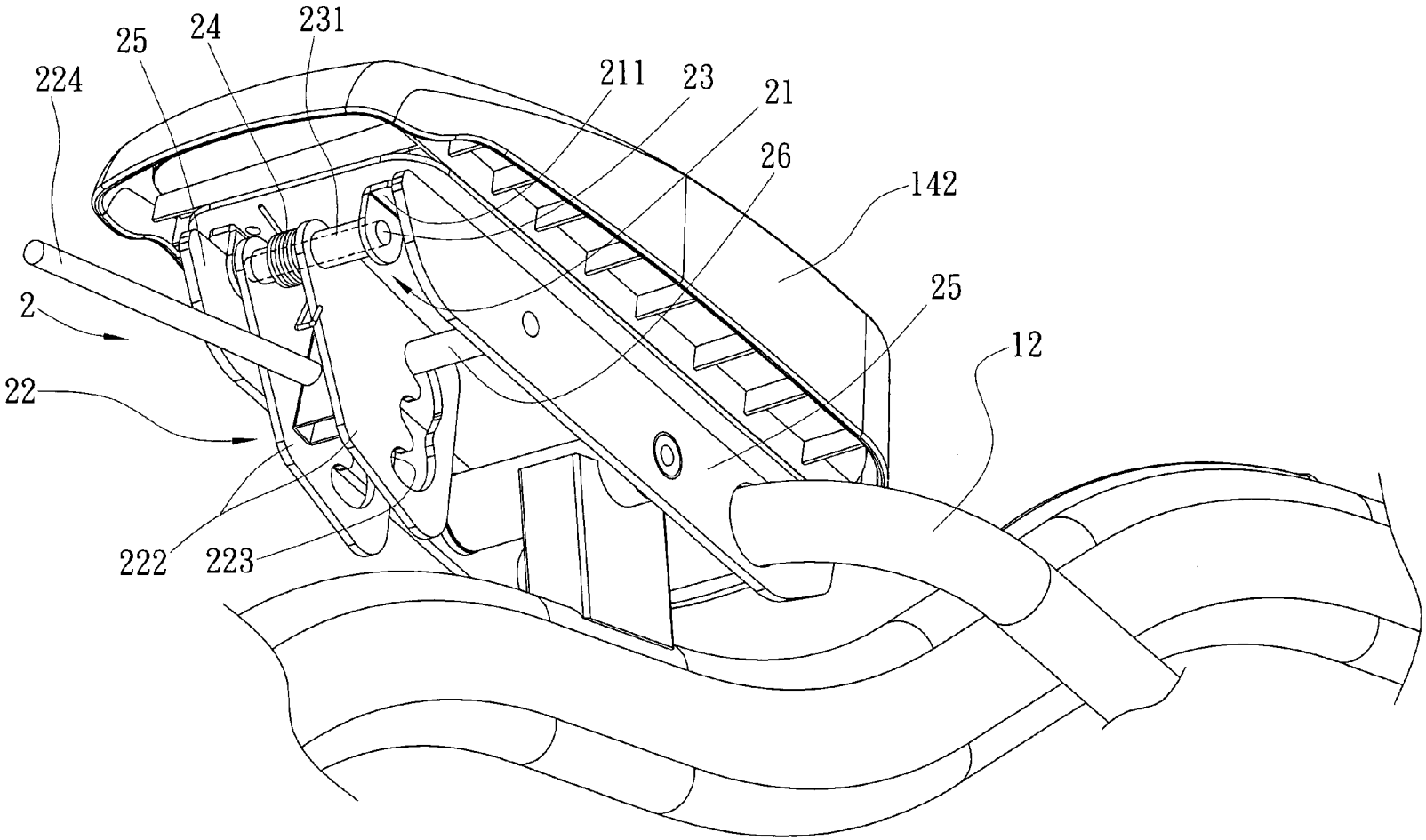
FIG. 3 is a perspective view of the pedal angle adjustable device of the present invention.

Referring to FIGS. 1 to 3, an elliptical trainer with the pedal adjustable device of the present invention comprises a base 1 with two rails at one end and a magnet wheel 13 at the other end of the base 1. Two swing bars 11 are pivotably connected to the base 1 and two pedal rods 12 are pivotably connected to two respective lower ends of the two swing bars 11. Two links 14 each have an end pivotably connected to the magnetic wheel 13 and the other end of each link 14 has a roller 141 which is movably engaged with the rails of the base 1. Two connection plates 25 are pivotably connected to a bending portion of each of the pedal rods 12 and respective one of two pedals 142 is connected to two respective ends the two connection plates 25. A tube is connected between the two connection plates 25 and fixed to an upright portion on each of the links 14, a pin extends through the two connection plates 25 and the tube so as to pivotably connect the two connection plates 25 to the link 14.

Figure 4:
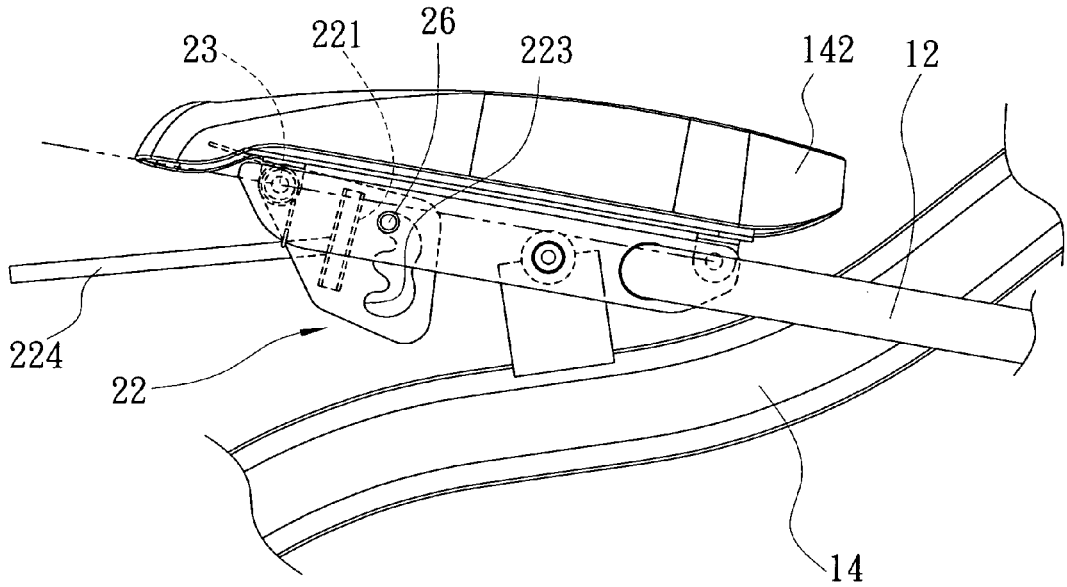
FIGS. 4 and 5 show that the pedal is adjusted an angle by the adjustable device of the present invention.
Figure 5:
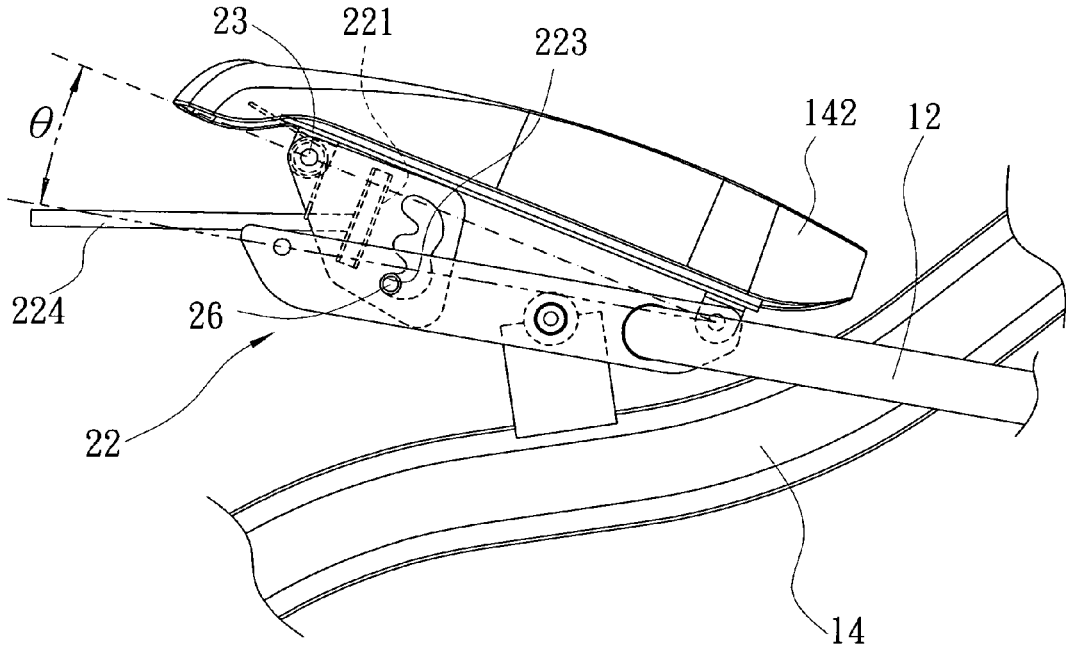

An adjustable mechanism 2 is connected between each of the pedals 142 and the two connection plates 25. The adjustable mechanism 2 includes a pivotable portion 21 which includes two lugs 211 fixed to an underside of the pedal 142 and an adjustable portion 22 which includes two adjustable plates 222 which are pivotably connected to the two lugs 211 by a pin 23 extending through the lugs 211 and the adjustable plates 222 of the adjustable portion 22. Two bushes 231 are located between the two adjustable plates 222 and between one of the lugs 211 and one of the adjustable plates 222, and the pin 23 extends through the two bushes 231. Each of the two adjustable plates 222 has a positioning hole composed of a plurality of positioning notches 223. A positioning rod 26 extends through the positioning holes of the two adjustable plates 222 and is pivotably connected between the two connection plates 25. A push block 221 is located between the two adjustable plates 222 of each pedal 142 and a handle 224 is connected to the push block 221. The positioning rod 26 can be pushed from one positioning notch 223 to another by the push block 121 when the user operates the handle 224 as shown in FIGS. 4 and 5. The user simply pushes the handle 224 to let the push block 121 to push the positioning rod 26 away from the push block 221 so as to removed from one of the positioning notches 223 and the pedal 142 can be pivoted an angle "θ" about the tube on the upright portion on the link 14, then the positioning rod 26 can be moved to another positioning notch 223. The adjustment is easy and convenient.

A torsion spring 24 is mounted to each of the pins 23 and one of two legs of the torsion spring 24 is in contact with an underside of the pedal 142 and the other leg is hooked to one of the two positioning plates 222. By the torsion spring 24, the positioning rod 26 is ensured that the positioning rod 26 is engaged with the positioning notches 223.

Figure 6:
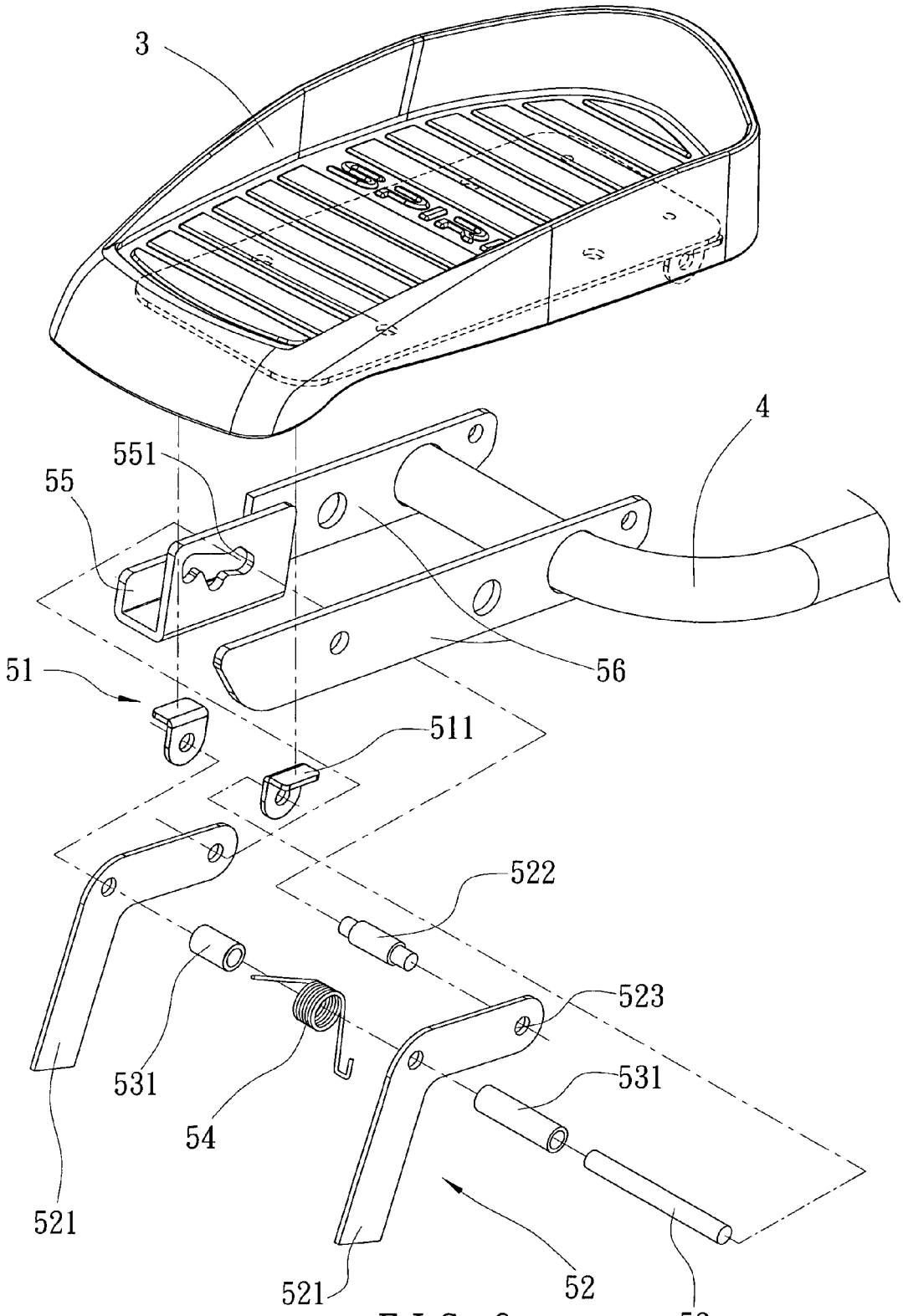
FIG. 6 is an exploded view to show another embodiment of the pedal angle adjustable device of the present invention.
Figure 7:
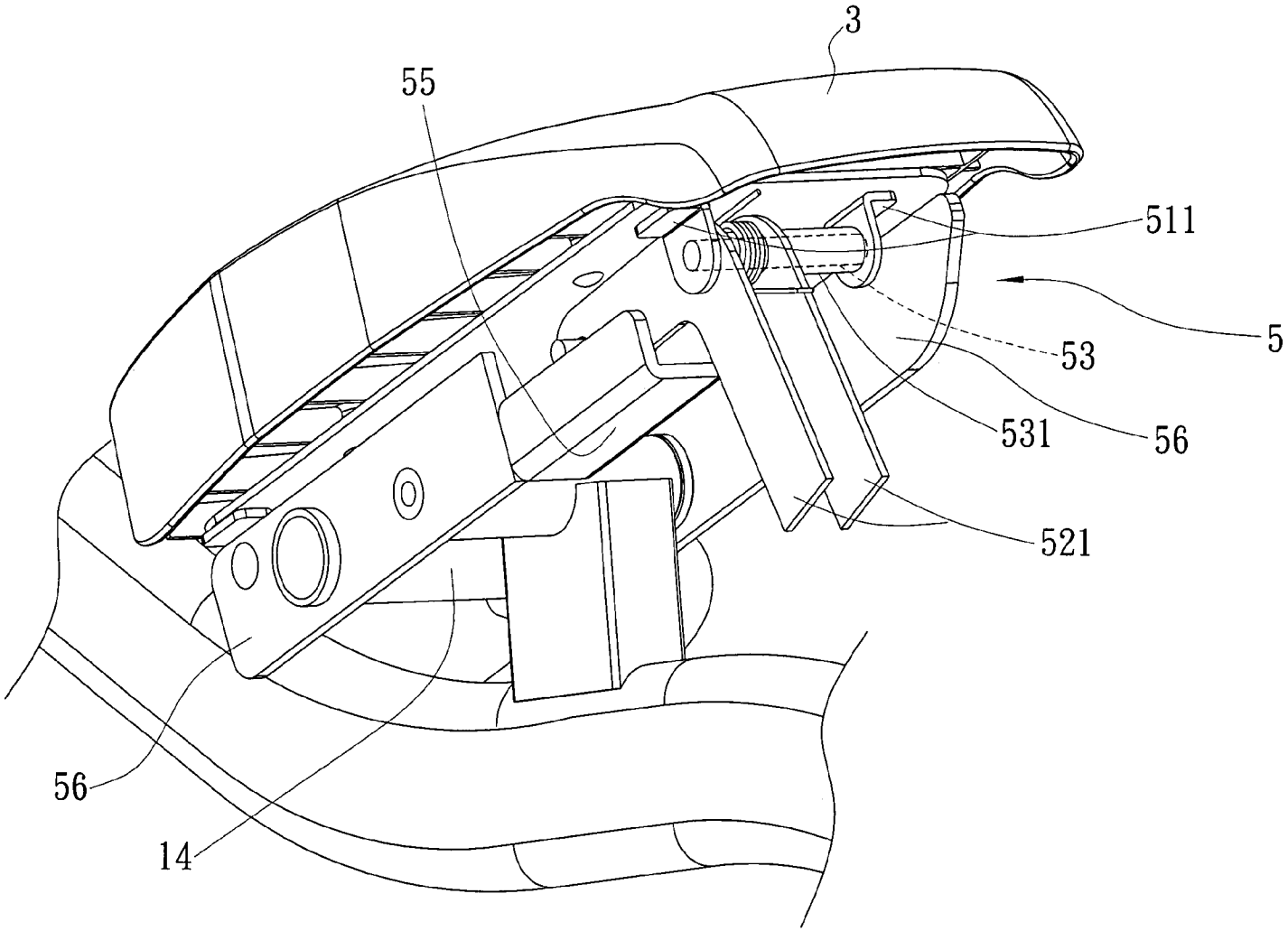
FIG. 7 is a perspective view of the pedal angle adjustable device of the present invention in FIG. 6.
Figure 8:
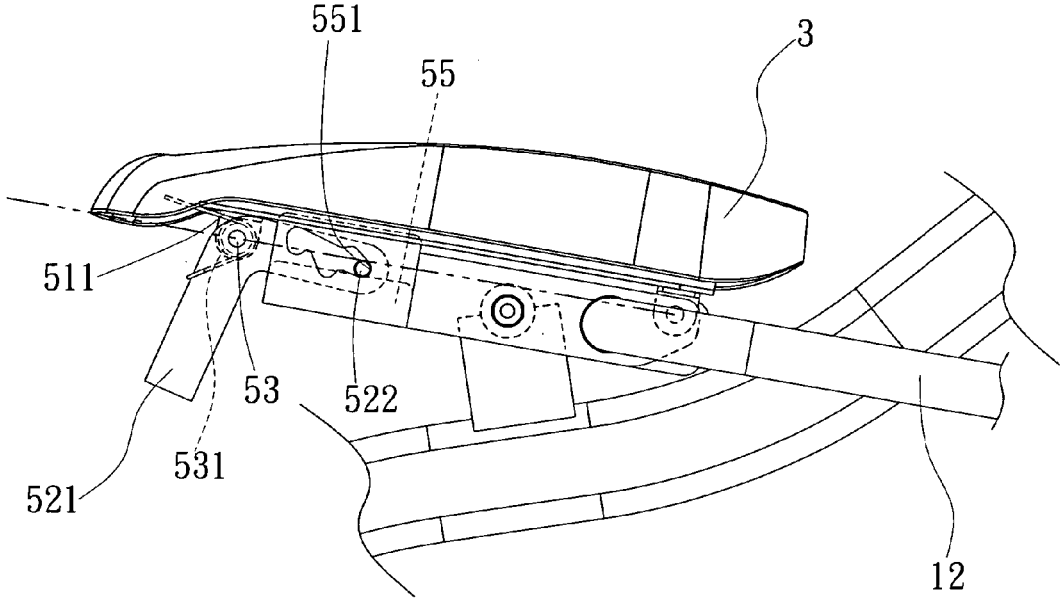
FIGS. 8 and 9 show that the pedal is adjusted an angle by the adjustable device of the present invention in FIG. 6.
Figure 9:
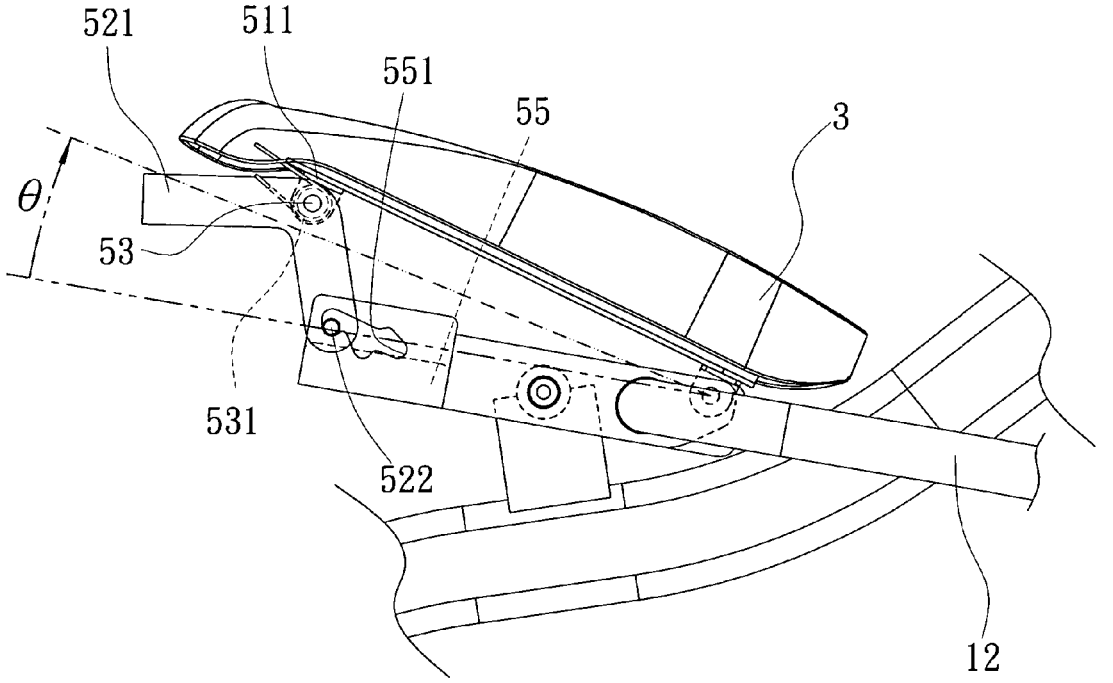
Figure 10:
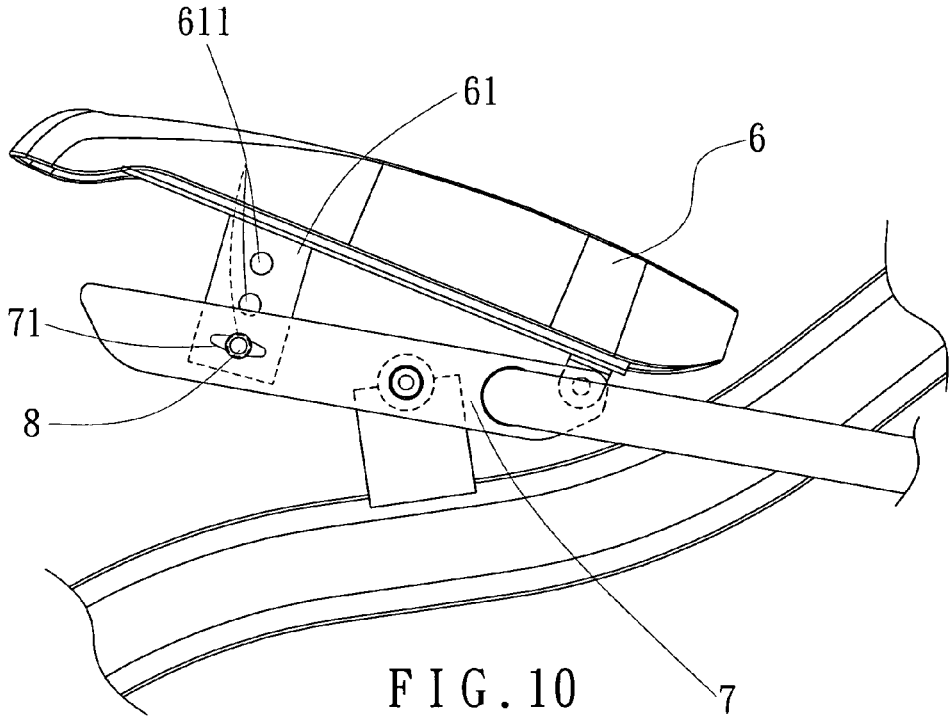
FIG. 10 PRIOR ART
FIG. 10 is a side view to show a conventional pedal angle adjustable device and the pedal.
Figure 11:
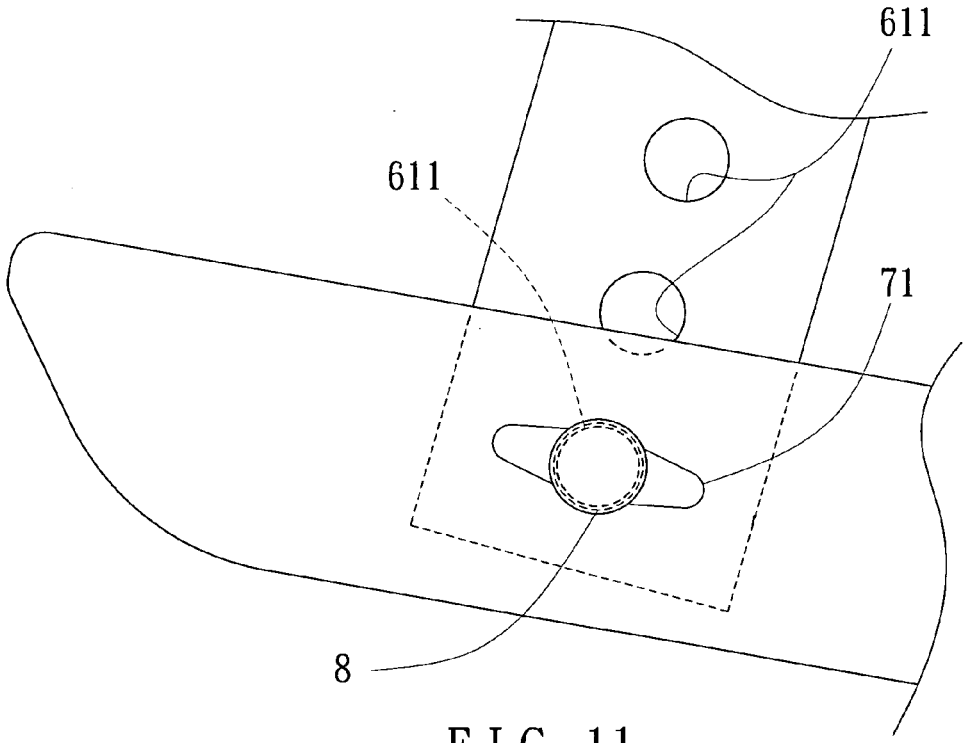
FIG. 11 PRIOR ART
FIG. 11 is an enlarged view to show the connection of the connection member and the two plates of the conventional pedal angle adjustable device.

Referring to FIGS. 6 and 7, a second embodiment of the pedal angle adjustable device of the present invention is used on the same elliptical trainer with a base 1, a magnet wheel 13, two rails, two swing bars 4, two links 14, and two pedals 3 which are respectively and pivotably connected to two connection plates 56 which are pivotably connected to the swing bar 4.

An adjustable mechanism 5 is connected between each of the pedals 3 and the two connection plates 56, wherein the adjustable mechanism 5 includes a pivotable portion 51 which includes two lugs 511 fixed to an underside of the pedal 3 and an adjustable portion 52 which includes two L-shaped bars 521 and a U-shaped positioning plate 55 which is fixed to one of the two connection plates 56. A positioning hole is defined through the positioning plate 55 and composed of a plurality of positioning notches 551. A pin 53 extends through the pivotable portion 51 and the two respective mediate portions of the L-shaped bars 521. Each of the two L-shaped bars 521 has a through hole 523 at one end thereof and a positioning rod 522 extends through the through holes 523 of the two L-shaped bars 521 and one of the positioning notches 551. Two bushes 531 are mounted to each of the pins 53 and located between one of the lugs 211 and one of the L-shaped bars 521, and between the two L-shaped bars 521. A torsion spring 54 is mounted to each of the pins 53 and one of two legs of the torsion spring 24 is in contact with an underside of the pedal 3 and the other leg is hooked to one of the two L-shaped bars 521.

The user can hold the L-shaped bars 521 to remove the positioning rod 522 from one positioning notch 551 to another to adjust an angle "θ" of the pedal 3.

While we have shown and described the embodiment in accordance with the present invention, it should be clear to those skilled in the art that further embodiments may be made without departing from the scope of the present invention.

What is claimed is:

1. An elliptical trainer comprising:

a base with a magnet wheel connected thereto, two swing bars pivotably connected to the base and two pedal rods pivotably connected to the two swing bars, two connection plates pivotably connected to each of the pedal rods and respective one of two pedals connected to the two connection plates, two links each having an end pivotably connected to the magnetic wheel and the other end of each link having a roller which is movably engaged with rails of the base, the two connection plates respectively pivotably connected to the two links, and an adjustable mechanism connected between each of the pedals and the two connection plates, the adjustable mechanism including a pivotable portion fixed to an underside of the pedal and an adjustable portion which includes two adjustable plates, a pin extending through the pivotable portion and the adjustable plates of the adjustable portion, each of the two adjustable plates having a positioning hole composed of a plurality of positioning notches, a positioning rod extending through the positioning holes of the two adjustable plates and pivotably connected between the two connection plates, a push block located between the two adjustable plates of each pedal and a handle connected to the push block, the positioning rod being pushed from one positioning notch to another by the push block.

2. The elliptical trainer as claimed in claim 1, wherein the pivotable portion includes two lugs fixed to the underside of each of the pedal.

3. The elliptical trainer as claimed in claim 1, wherein a torsion spring is mounted to each of the pins and one of two legs of the torsion spring is in contact with an underside of the pedal and the other leg is hooked to one of the two positioning plates.

4. The elliptical trainer as claimed in claim 2, wherein two bushes are mounted to each of the pins and located between the two adjustable plates and between one of the lugs and one of the adjustable plates.

5. An elliptical trainer comprising:

a base with a magnet wheel connected thereto, two swing bars pivotably connected to the base and two pedal rods pivotably connected to the two swing bars, two connection plates pivotably connected to each of the pedal rods and respective one of two pedals connected to the two connection plates, two links each having an end pivotably connected to the magnetic wheel and the other end of each link having a roller which is movably engaged with rails of the base, the two connection plates respectively pivotably connected to the two links, and an adjustable mechanism connected between each of the pedals and the two connection plates, the adjustable mechanism including a pivotable portion fixed to an underside of the pedal and an adjustable portion which includes two L-shaped bars and a positioning plate which is fixed to one of the two connection plates, a positioning hole defined through the positioning plate and composed of a plurality of positioning notches, a pin extending through the pivotable portion and the two respective mediate portions of the L-shaped bars, each of the two L-shaped bars having a through hole at one end thereof and a positioning rod extending through the through holes of the two L-shaped bars and one of the positioning notches.

6. The elliptical trainer as claimed in claim 5, wherein the pivotable portion includes two lugs fixed to the underside of each of the pedal.

7. The elliptical trainer as claimed in claim 5, wherein a torsion spring is mounted to each of the pins and one of two legs of the torsion spring is in contact with an underside of the pedal and the other leg is hooked to one of the two L-shaped bars.

8. The elliptical trainer as claimed in claim 6, wherein two bushes are mounted to each of the pins and located between one of the lugs and one of the L-shaped bars, and between the two L-shaped bars.

* * * * *